US007374517B2

(12) United States Patent
Lockett

(10) Patent No.: US 7,374,517 B2
(45) Date of Patent: May 20, 2008

(54) PORTABLE THERAPEUTIC SEAT EXERCISE APPARATUS AND METHOD

(76) Inventor: Ricky Poole Lockett, 2395 Old Coach Trail, Clearwater, FL (US) 33765

( * ) Notice: Subject to any disclaimer, the term of this patent is extended or adjusted under 35 U.S.C. 154(b) by 378 days.

(21) Appl. No.: 11/280,579

(22) Filed: Nov. 16, 2005

(65) Prior Publication Data

US 2007/0111862 A1 May 17, 2007

(51) Int. Cl.
*A63B 21/00* (2006.01)
*A63B 22/14* (2006.01)
*A47C 3/02* (2006.01)

(52) U.S. Cl. ..... 482/131; 482/146; 297/271.5

(58) Field of Classification Search ..... 482/34, 482/77, 79, 80, 140, 146, 147, 131, 132; 446/396; 297/202, 136, 137, 271.5, 255.1; 472/110–112, 114

See application file for complete search history.

(56) References Cited

U.S. PATENT DOCUMENTS 574,503 A * 1/1897 Van Meter ..... 297/200
1,497,243 A * 6/1924 Martin ..... 606/237
5,048,823 A * 9/1991 Bean ..... 482/146
5,279,533 A * 1/1994 Yin et al. ..... 482/147
5,288,127 A * 2/1994 Berg et al. ..... 297/312
5,643,154 A * 7/1997 Awbrey et al. ..... 482/111
5,810,703 A * 9/1998 Stack ..... 482/146
6,146,343 A * 11/2000 Stewart ..... 601/118
6,224,151 B1 * 5/2001 McMullen, Jr. ..... 297/202
6,945,920 B1 * 9/2005 Kemery et al. ..... 482/146
7,137,938 B2 * 11/2006 Gottlieb ..... 482/146
7,264,580 B2 * 9/2007 Lu ..... 482/146

* cited by examiner

*Primary Examiner*—Stephen R. Crow
*Assistant Examiner*—Allana Lewin
(74) *Attorney, Agent, or Firm*—Dorothy S. Morse

(57) ABSTRACT

A portable therapeutic seat exercise apparatus and method that provide a lightweight personal exerciser designed for a person to use to improve physical status, and for the exercise, alignment, and stress reduction of a person's trunk, spine, abdomen, pelvis, and thighs. It encourages and enhances low back mobility in contrast to the static nature of regular sitting. It consists of a lightweight contoured seating surface supported by at least one arcuate hemispherical base that allows unrestricted motion in all directions, including twisting, tilting, and rocking. It can be placed on many seating surfaces including but not limited to sofas, dining chairs, school desk chairs, office chairs, factory benches, and motor vehicle seats. Its use facilitates low back muscular stabilization, conditioning, strengthening, coordination, and enhancement of proprioceptive senses. Interchangeable parts and add-on attachments can be used in differing combination to vary height, depth, position, and arc of the seat-supporting base.

20 Claims, 7 Drawing Sheets

FIG 11
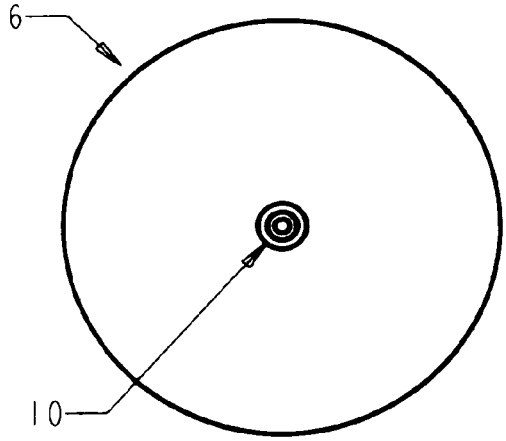
FIG 12
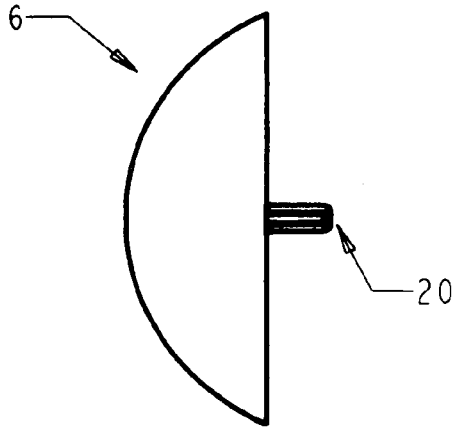
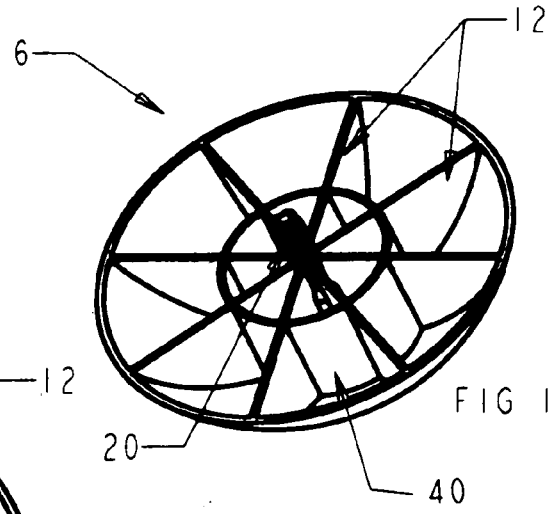
FIG 14
FIG 13
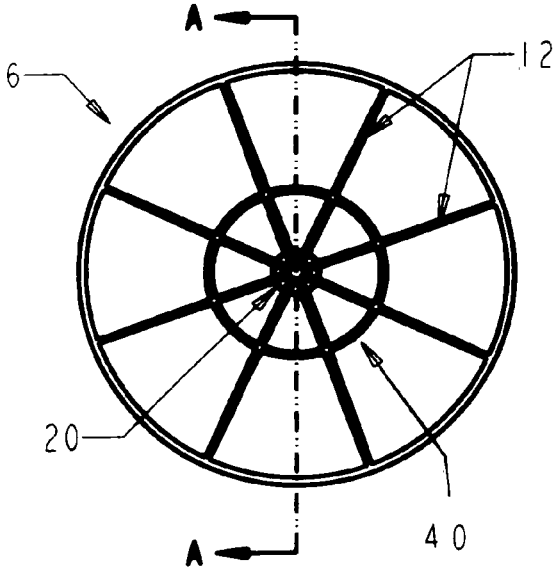
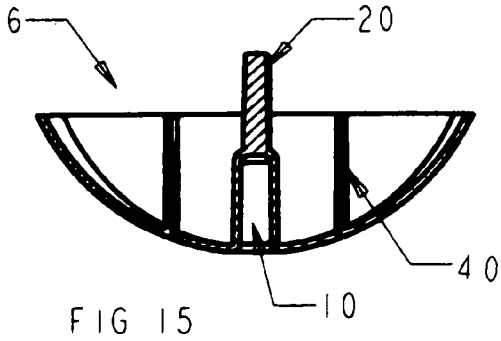
FIG 15

FIG 16
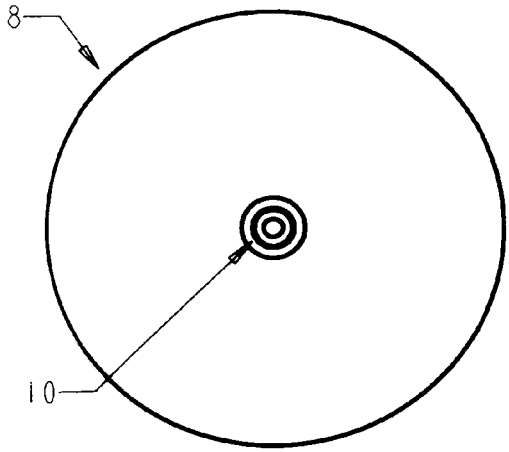
FIG 17
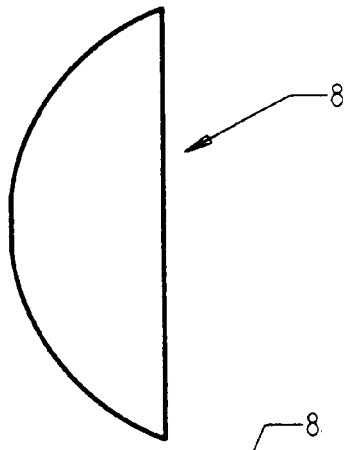
FIG 18
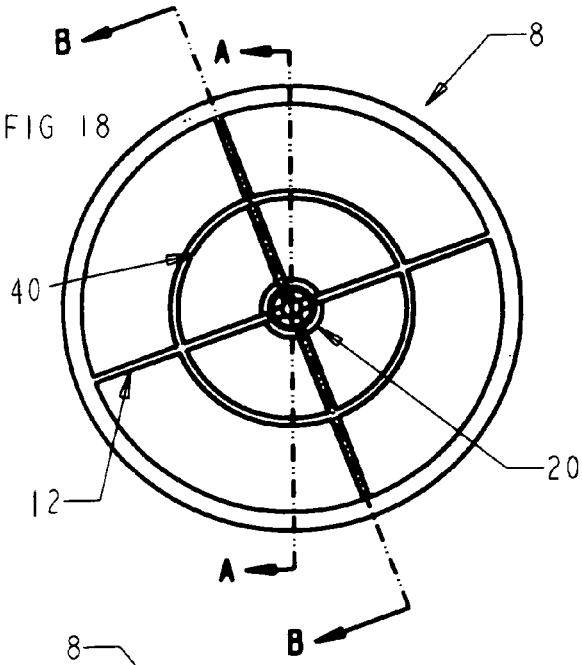
FIG 19
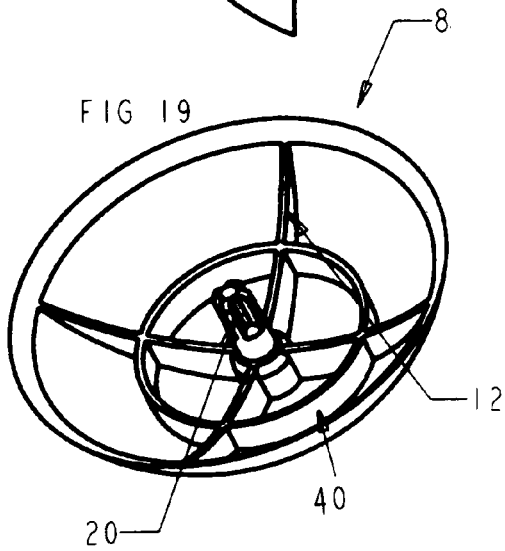
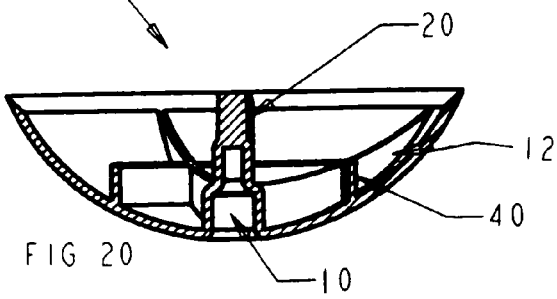
FIG 20
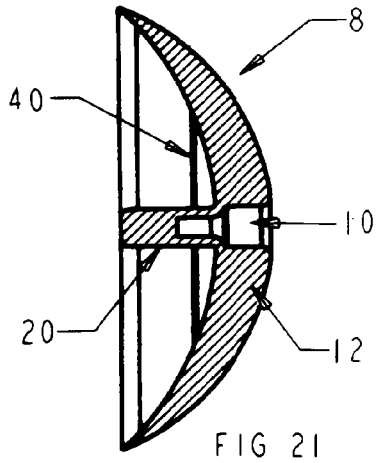
FIG 21

FIG 22
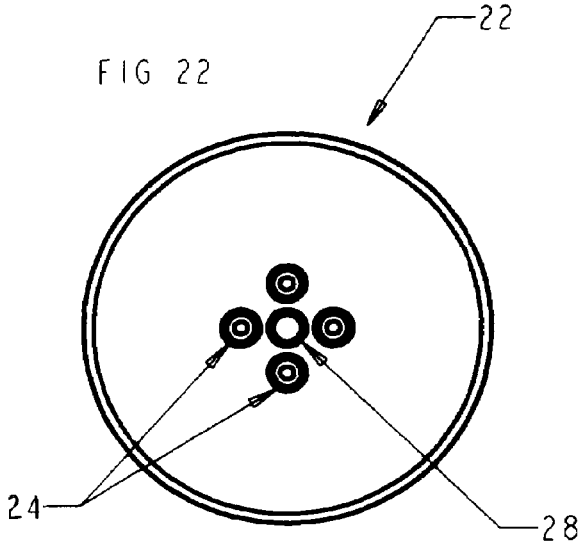
FIG 23
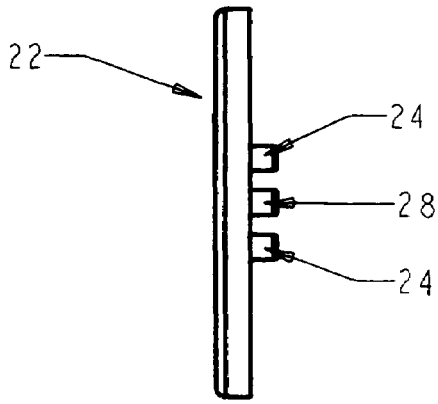
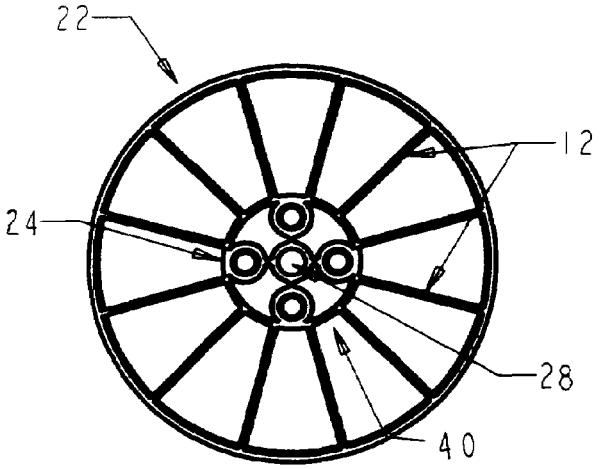
FIG 24
FIG 25
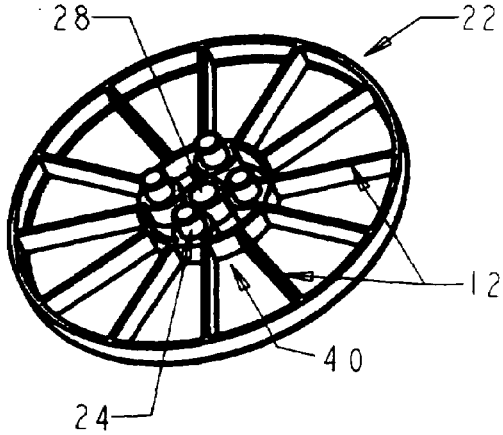

PORTABLE THERAPEUTIC SEAT EXERCISE APPARATUS AND METHOD

CROSS-REFERENCES TO RELATED APPLICATIONS

None.

BACKGROUND OF THE INVENTION

1. Field of the Invention

This invention relates to the field of a portable therapeutic seat exercise apparatus and a method particularly to facilitate the increased circulation, nutrition, and position sense to the low back, pelvis, gluteal, and legs of the user. The apparatus of the present invention supports pelvic, low back movement in all directions including rocking, tilting, rotation, and wobbling. It helps to reduce pain and increase function for those afflicted with back/pelvic/gluteal pain; optimize healing environment, stimulate rehabilitation, limit time lost from work, and promote health, injury prevention and pre-habilitation. The method of exercise derived from use of the present invention apparatus is particularly beneficial for those at high risk of developing mechanical back pain such as that experienced with: degenerative disc disease, disc herniation, facet arthropathy, degenerative joint disease, and spinal stenosis, due to work environments with risk factors associated with the development of degenerative conditions, which may include prolonged sitting, static sitting, exposure to vibration; and/or personal risk factors, such as but not limited to sedentary work, lack of exercise, loss of low back mobility, weakness, and postural abnormalities, all of which can be stabilized in chronic conditions; restored in acute injuries; and/or prevented, primarily, while seated and actively focused on exercise, whether at home, work, sporting events, or while driving, riding, or simply relaxing. Use of the present invention provides effective exercise for stabilizing muscles, preserving circulation, improving nutrition, maintaining neurological pathways; enhancing position/postural awareness, and optimizing function; and it is effective for low back, pelvic, abdominal, gluteal exercise while its user sits; and also effective for stabilization, strengthening, coordination, and flexibility training while its user is doing something else.

2. Description of the Related Art

Back pain has been called a worldwide epidemic. It has become an $80-100 billion dollar cost to industries in the United States of America, resulting in increasing disability, particularly among the most productive workers, whose ages range between 20 and 45 years. This problem has led to an explosion of so-called ergonomic furniture, particularly chairs to maintain lumbar lordosis. Instead of the occupant adjusting to the chair, ergonomic chairs adjust to a variety of sizes and fit the environment to the man. These ergonomic chairs are designed to decrease the negative effects of prolonged sitting on the body of the user, by supporting the position of comfort. In the long-run, ergonomics does limit stress to support structures (including bone/vertebrae, disc, muscle, joints, ligaments, nerves, and fascia), however, supporting a position of comfort alone does not result in the occupant's development of strength, flexibility, and coordination, nor provide the occupant with a sense of postural awareness, as does the present invention.

Exercise remains a key factor for optimizing health, even that of the spinal complex, which due to its particular combination of nerves, muscle joints, and bones, is inherently unstable. Many muscles help to maintain the stability of the spinal complex, and exercise is needed to strengthen those muscles. Over the years exercises have been taught to build back and abdominal musculature, yet back pain has not been eliminated. As it turns out, our focus was on the regional muscles, and the local spinal stabilizing muscles were neglected. Local muscles are responsible for controlling intersegmental motion, and are where the focus of exercise must be directed to obtain optimum beneficial health effect. However, when we look at the most commonly performed exercises (calisthenics, free weights, elastic tubing, or exercise machines), it is the superficial regional muscles that are being stimulated and often times the spinal stabilizing back muscles are protected, and ultimately undergo little stress or stimulation.

The low back region has a normal curvature known as lordosis. The lordotic position helps to protect the lumbar disc, spine, nerves, and joints. Maintaining a neutral lordotic curve in the lumbar spine promotes back health through a decrease in stress, maintenance of mobility, adequate circulation and nutrition. Also, preservation of a neutral low back curvature, particularly while sitting, aides in better postural control of the head and neck region. However, back and/or neck pain affect eighty percent (80%) of the world's population at some point during their lives. Much of the problem relates to a mechanical breakdown of supporting structures. Those structure include: bone (vertebrae), disc, muscle, joints, ligaments, nerves, and fascia, each of which is capable of producing a painful response to strain, overuse, breakdown, or injury. Sedentary lifestyles, poor sitting postures, lack of exercise, poor physical conditioning, vibration, overuse, stress, strain, and aging, all contribute to a gradual decline in functional status of support structures and the onset of pain. Ergonomic devices (particularly chairs) assist the occupant in maintaining a position based on the design of the equipment, for example lumbar lordosis. Ergonomic benefits are realized by having work station equipment adjustable to different positions and sizes of people working at those work stations. Typical work stations include computers, desk, sewing machines, factory work stations, etc. Unlike ergonomic approaches for chair design, the portable therapeutic seat exercise apparatus and method of the present invention is not designed to guide the body into any particular position. Instead, lordosis is assisted by use of the portable therapeutic seat exercise apparatus of the present invention when it elevates the hips higher than the knees causing an anterior rotation or tilt of the pelvis. By providing a reasonably unstable surface to sit on, the present invention encourages development of spinal complex stability through muscle activity that enhances the development of strength, endurance, coordination, flexibility, postural, kinesthetic, and proprioceptive awareness.

The present invention comprises a portable therapeutic seat exercise apparatus and a method for its use. More specifically, it relates to a device to be placed on top of typical seating surfaces to provide a tool for developing postural muscles and postural awareness of the low back, pelvis, and gluteal region. The present invention can comprise a unitary seat/base combination with add-on accessories, or comprise a variety of seats, bases, and/or accessories for addition to the base or seat to change its center of gravity to the left, right, forward, and backward. A single or multiple vaginations in the base and/or seat permit attachment of optional add-on accessories used to change base characteristics and thus achieve different occupant motion. The apparatus has unlimited mobility and is inherently unstable. It is the effort of the occupant to maintain stability that forces the development of postural muscles. The apparatus also allows a method of exercise focused on the development of local spinal stabilizing muscles of the lumbar and abdominal regions. The freedom of motion permitted by the present invention encourages alignment changes in support structures that reduce the concentration of forces, thus limiting tissue breakdown and stimulating circulation and nutrition.

The episodes of back pain affecting more than 80% of the population in the industrialized nations affect people in different ways. Some may resolve within weeks, while others become recurrent or develop into a chronic problem. The pain is caused by injuries to support structures, and can arise due to injuries to bones, joints, muscles, ligaments, nerves, discs, or the alteration of circulation. Aside from trauma, mechanical dysfunction and degeneration are primary reasons for the development of pain. Many risk factors also contribute to the development of back pain, particularly sedentary occupations, lack of exercise, poor posture, muscle weakness, loss of flexibility, and exposure to the vibration experienced in motor vehicles while commuting. Optimal health of the low back requires movement. Movement enhances the production of synovial fluid in the zygapophyseal (facet) joints, maintaining the nutrition of the cartilage and thereby limiting degeneration and slowing the onset of osteoarthritis. Movement also provides circulation to discs by a pumping mechanism at the end plates of the vertebrae leading to a diffusion of nutrients to the disc. Maintaining disc vitality slows the rate of degeneration, ultimately preserving disc height. Loss of disc height results in increased stress on the facet joints, foraminal narrowing, and spinal stenosis, each resulting in back pain. Prolonged sitting, static sitting, riding in vehicles, poor posture, and altered body mechanics place stress on the disc and joints. Movement limits the mechanical stress and improves disc and joint nutrition. Research shows flexion and extensor motions of the intervertebral segments improve nutrition to the disc and facet joints.

The muscles of the low back, abdomen, pelvis, and gluteal areas are required for mobility and spinal complex stability. When they are healthy, strong, and flexible, muscle provides shock absorption and load attenuation. Muscle weakness results in mechanical abnormalities, postural abnormalities, and dysfunction. Dysfunction leads to pain of the muscles (overuse, strain) and other structures. Sedentary occupations lead to a decline in muscle strength, flexibility, and coordination, resulting in a greater risk of developing a painful condition with a resultant loss of function.

Seats, chairs, cushions, and supports are designed to support the body, particularly the seat and low back, in anatomically favorable and non-stressed positions. Good support leads to a sense of comfort, and comfort leads to muscle relaxation. However, with too much relaxation and limited stimulation, muscles weaken. Thus, sitting passively for prolonged periods weakens muscles and increases stress on discs, resulting in disc degeneration. To prevent muscle weakening, active dynamic seating has been introduced wherein back muscles and intervertebral discs remain active. Other devices have introduced rocking, swiveling, tilting, and undulating motions. Successful stability exercise requires active movement performed frequently, without it becoming monotonous. Motorized equipment has been utilized for such purposes because it provides the benefit of continuous movement that can be performed on a daily basis. However, motorized equipment has disadvantages, including elevated cost and complexity of construction, as well as noise from the motor, and the wear and tear on the equipment. Overcoming the obstacles to healing and health maintenance requires a device that is portable and able to be used almost anywhere by almost anybody; a device that is simple to manufacture, inexpensive, and effective at developing strength, coordination, and flexibility; and a device that can provide stabilization to the lumbar spine and pelvic areas. Further, the device should be effective in primary, secondary, and tertiary prevention.

The present invention is effective in primary prevention by developing local muscular strength, coordination, and flexibility, as well as enhancing position sense and postural awareness. It allows continuous muscular stimulation on a daily basis while a person performs another task, such as television viewing, writing, driving, eating dinner, and working. It is also of particular benefit to persons performing computer/desk/factory tasks. Further, it can be used by young persons required to sit for prolonged periods at school or older persons while engaged in other sedentary activities. In addition, the present invention apparatus is effective in secondary prevention enabling a rapid return from an acute injury. It promotes an early return through activity with graduated re-introduction of stress to the injured structures. Early mobility stimulates tissue healing and helps to maintain adequate nutrition and circulation to the area. With early mobility, fewer detrimental effects occur and health is more easily regained. Pain is also controlled more easily. Dysfunction is reduced, limiting time away from work and allowing a more rapid return to productivity. Thus, the portable therapeutic seat exercise apparatus and method of the present invention facilitates a decrease in pain and increase in function, leading to a more rapid return to work, play, and life. Additionally, the present invention apparatus is effective in tertiary prevention by restoring motion, strength, flexibility, and coordination to an area that has had longstanding dysfunction and pain. Motion is beneficial to muscles, joints, discs, ligaments, and bone, as it improves circulation and nutrition. A person with longstanding dysfunction and pain can be brought along slowly by use of the present invention, and learn to move again without fear of pain. Spinal stabilization improves as the trunk, spine, and torso muscles are exercised through use of the present invention. The increased mobility achieved through present invention use leads to development of position sense and postural awareness, and does not require any athletic ability to perform.

The method of exercise involving use of the present invention is effective and easy to perform utilizing inexpensive durable equipment. It simply encourages mobility in a position that typically does not lend itself to therapeutic conditioning. It also focuses on an area of the body where mobility, stability, strength, and coordination are of paramount importance. The present invention method of exercise fosters a person's own arc of movement, not dictating mobility patterns based on a mechanical coupling, such as a universal type joint. The portable therapeutic seat exercise apparatus of the present invention can be utilized for specific therapeutic exercises or as a preventive tool for daily use to promote therapeutic motion and optimize nutrition, as well as maintain postural sense and awareness. Its design facilitates a rocking motion of the lumbosacral pelvis in any direction (including pivoting and twisting), focusing motion to the lumbar interspinal segments producing localized therapeutic activity. Local therapeutic motion is performed by the intrinsic spinal muscles that are responsible for low back stabilization and postural control. The portable therapeutic seat exercise apparatus and method is to be used by persons having pain or discomfort while sitting, as well as persons concerned about degeneration of spinal structures related to prolonged sitting, driving, and/or heavy work, and persons generally attempting to obtain, regain, or maintain spinal health.

The portable therapeutic seat exercise apparatus and method of the present invention is usable for the treatment of: acute and chronic mechanical back pain (Disc Herniation, Degenerative Disc Disease, Facet Syndrome, Sacroiliac Sprain, Muscle Strain, Ligament Sprain), back pain prevention, vestibular stimulation, osteoporosis, strokes, sports training, pelvic pain, spondylolisthesis, spondylolysis, spondylosis, scoliosis, stenosis, mild to moderate obesity, etc. Further, it can be used for the pediatric, geriatric, orthopedic, cardiac, bariatric, neurologic, and sports medicine populations. The present invention device conditions muscles contributing to the local stabilizing system of the spine, including: intertransversaii, interspinales, lumbar multifidus, longissimus, thoracis pars lumborum, iliocostalis, lumborum pars lumborum, and quadratus lumborum. It is proposed that these muscles serve as length transducers and position sensors, and have a predominant proprioceptive role. Such muscles influence kinesthetic sense in the low back region and affect patterns of muscle activity. Further, the muscles of the local stabilizing system by in large have vertebrae-vertebrae attachments.

Another group of muscles, known as global muscles, are also stimulated by this mechanism or exercise via the portable therapeutic seat exercise apparatus of the present invention. Global muscles are larger and more superficial, and result in greater spinal motion. These muscles include: obliquus internus abdominis, obliquus externus abdominis, rectus abdominis, quadrutus lumburum, erector spine, and iliopsoas.

Exercising with the present invention also leads to the stimulation of gluteal (maximum, medius, and minimus), hamstrings, quadriceps, and pelvic floor muscles. Since spinal control requires the elements of stability and movement of both the local and global systems, these systems must be coordinated to fulfill our need for spinal health. The portable therapeutic seat exercise apparatus of the present invention provides a device and method that stimulates the muscles of both the local and global systems for improved spinal health.

As in any exercise routine, use of the present invention apparatus needs to be individualized, with individualization depending upon the goals of use. When the goal is developing muscle strength and mobility, the portable therapeutic seat exercise apparatus of the present invention can be used every other day for 5-10 minutes. For the goal of developing proprioceptic and kinesthetic sense, the present invention can be used daily, more-so as a balancing system, for 15-30 minutes whereby the user employs muscle activity to maintain an upright position. To develop total spinal health, the portable therapeutic seat exercise apparatus of the present invention can be used continuously while conducting other activities, with the length of use based on individual tolerance.

Exchange of part and accessories can adapt the portable therapeutic seat exercise apparatus of the present invention to a variety of heights, which are utilized to accommodate the firmness of different seating surfaces and increase range of motion. The addition of accessories to the present invention can also provide a variety of base widths, which alter the level of stability, with a wide base being more stable and therefore appropriate for novices. As the base of the present invention is narrowed, the stability decreases and is more appropriate for more athletic users.

The present invention is directed to exercise devices, therapeutic chairs, seats, cushions, and methods of exercise simulating activities intending to position, rotate, tilt, or exercise the low back and/or pelvis. Many of the following devices provide the capability for tilting, rotating, and/or exercising the low back and pelvis areas of a seated person. However, each is distinguishable in structure from the present invention in one or more significant ways.

The following invention allows a seat to be rotated 90 degrees or more. However, its structure is distinguishable from the present invention.

U.S. Pat. No. 4,834,452 Goodrich May 30, 1989

The following inventions provide seat cushions contoured for properly aligning and supporting the pelvis, low back, or gluteal regions of a seated person. However, each of their structures is also distinguishable from that of the present invention.

| U.S. Pat. No.: | | |
|---|---|---|
| 679,915 | Rudolf | Aug. 6, 1901 |
| 2,314,080 | Dine et al. | Jul. 3, 1940 |
| 2,734,556 | Hebrank | Feb. 14, 1956 |
| 2,800,165 | Talalay | Jul. 23, 1957 |
| 2,819,712 | Morrison | Jan. 14, 1958 |
| 2,981,317 | Cartwright Jr. et al. | Apr. 25, 1961 |
| 3,148,391 | Whitney | Sep. 13, 1964 |
| 3,222,694 | Schrek | Dec. 14, 1965 |
| 3,323,151 | Lerman | Jun. 6, 1967 |
| 3,333,286 | Biolik | Aug. 1, 1967 |
| 3,336,610 | Geddngs | Aug. 22, 1967 |
| 3,337,884 | Meier | Aug. 29, 1967 |
| 3,376,070 | Johnson | Apr. 2, 1968 |
| 3,503,649 | Johnson | Mar. 31, 1970 |
| 3,613,671 | Poor | Oct. 19, 1971 |
| 3,863,978 | Gillings Jr. | Feb. 4, 1975 |
| 3,867,732 | Morrell | Feb. 25, 1975 |
| 3,890,004 | Rail | Jun. 17, 1975 |
| 3,968,530 | Dyson | Jul. 13, 1976 |
| 4,179,158 | Flaum et al. | Dec. 18, 1979 |
| 4,518,203 | White | May 21, 1985 |
| 4,635,306 | Willey | Jan. 13, 1987 |
| 4,673,216 | Aller | Jun. 16, 1987 |
| 4,830,345 | Mar | May 16, 1989 |
| 4,846,076 | Menges Sr. et al. | Jul. 11, 1989 |
| 4,890,886 | Opsvik | Jan. 2, 1990 |
| 4,925,241 | Genaci | May 15, 1990 |
| 4,987,625 | Edelson | Jan. 29, 1991 |
| 5,029,350 | Edelson | Jul. 9, 1991 |
| 5,134,740 | Summer | Aug. 4, 1992 |
| 5,288,127 | Berg et al. | Feb. 22, 1994 |
| 5,490,717 | Greene | Feb. 13, 1996 |
| 6,079,782 | Berg et al. | Jun. 27, 2000 |
| 6,578,217 | Roberson | Jun. 17, 2003 |

The following inventions provide seating to control posture, position, or to decrease pressure on anatomic structures, each having a therapeutic function. However, each of their structures is distinguishable from the present invention.

| U.S. Pat. No.: | | |
|---|---|---|
| 2,482,996 | Wisby | Sep. 27, 1949 |
| 2,799,323 | Berg | Jul. 16, 1957 |
| 4,552,404 | Cungleton | Nov. 12, 1985 |
| 4,607,882 | Opsvik | Aug. 26, 1986 |
| 4,798,414 | Hughes | Jan. 17, 1989 |
| 4,836,603 | Beach et al. | Jun. 6, 1989 |
| 4,848,742 | Lindley et al. | Jul. 18, 1989 |
| 5,022,385 | Harza | Jul. 11, 1991 |
| 5,387,178 | Moses | Feb. 7, 1995 |

-continued

| U.S. Pat. No.: | | |
|---|---|---|
| 5,577,801 | Glockl | Nov. 26, 1996 |
| 5,580,128 | Johnson et al. | Dec. 3, 1996 |
| 5,588,704 | Harza | Dec. 31, 1996 |
| 5,713,632 | Su | Feb. 3, 1998 |
| 5,728,049 | Alberts | Mar. 17, 1998 |
| 5,735,575 | Harza | Apr. 7, 1998 |
| 5,746,481 | Obermaier | May 5, 1998 |
| 5,913,568 | Brightbill et al. | Jun. 22, 1999 |
| 6,003,944 | Clockel | Dec. 21, 1999 |
| 6,033,021 | Udo et al. | Mar. 7, 2000 |
| 6,209,958 B1 | Thole | Apr. 3, 2001 |
| 6,340,207 B1 | Brightbill et al. | Jan. 22, 2002 |
| 6,357,827 B1 | Brightbill et al. | Mar. 19, 2002 |
| 6,398,303 | Herrman et al. | Jun. 4, 2002 |
| 6,688,689 | Thorn | Feb. 10, 2004 |

The following inventions provide exercise devices, chairs, systems, and health equipment. However, their structures are also distinguishable from the present invention.

| U.S. Pat. No.: | | |
|---|---|---|
| 1,686,423 | Thumson | Oct. 2, 1928 |
| 3,043,591 | Sellner | Jul. 10, 1962 |
| 3,641,995 | Brandt | Feb. 15, 1972 |
| 3,667,453 | Schenck et al. | Jun. 6, 1972 |
| 3,785,642 | Sterlicchi | Jan. 15, 1974 |
| 4,146,222 | Hriber | Mar. 27, 1979 |
| 4,182,511 | Camp Jr. | Jan. 8, 1980 |
| 4,354,677 | Young | Oct. 19, 1982 |
| 4,405,129 | Stuckey | Sep. 20, 1983 |
| 4,801,140 | Bergeron | Jan. 31, 1989 |
| 4,815,732 | Mahui | Mar. 28, 1989 |
| 4,976,425 | Barnes Jr. | Dec. 11, 1990 |
| 5,647,830 | Togai | Jul. 15, 1997 |
| 5,743,838 | Willis | Apr. 28, 1998 |
| 6,030,323 | Fontenot et al. | Feb. 29, 2000 |
| 6,063,012 | Berkowits et. al | May 16, 2000 |

The following inventions provide seating mechanisms that tilt, rotate, swivel to reposition the person for an improved ergonomic and functional position. Motions are typically performed unidirectionally, unlike the portable therapeutic seat exercise apparatus and method herein which affords active mobility in all directions through a simple and portable seat exercising apparatus.

| U.S. Pat. No.: | | |
|---|---|---|
| 2,719,571 | Taylor | Oct. 4, 1955 |
| 2,944,591 | Murrill Jr. | Jul. 12, 1960 |
| 3,191,594 | Bagnell | Jun. 29, 1965 |
| 3,580,634 | Bock | May 25, 1971 |
| 4,083,599 | Golfney | Apr. 11, 1978 |
| 4,095,770 | Long | Jun. 20, 1978 |
| 4,099,697 | Von Schuckman | Jul. 11, 1978 |
| 4,185,803 | Kalvatn | Jan. 29, 1980 |
| 4,183,492 | Meiller | Jan. 15, 1980 |
| 4,236,752 | Mizelle | Dec. 2, 1980 |
| 4,254,990 | Keiley | Mar. 10, 1981 |
| 4,372,606 | Faull | Feb. 8, 1983 |
| 4,425,863 | Cutler | Jan. 17, 1984 |
| 4,500,062 | Sandvik | Feb. 19, 1985 |
| 4,515,337 | Torras | May 7, 1985 |
| 4,605,334 | Kalvatn | Aug. 12, 1986 |
| 4,905,994 | Hartz | Mar. 6, 1990 |
| 5,046,694 | Martin | Sep. 10, 1991 |
| 5,054,739 | Wallin | Oct. 8, 1991 |

-continued

| U.S. Pat. No.: | | |
|---|---|---|
| 5,372,347 | Minnich | Dec. 13, 1994 |
| 5,409,295 | Edstrom | Apr. 25, 1995 |
| 5,549,536 | Clark | Jun. 16, 1998 |
| 5,871,257 | Dunder Sr. | Feb. 16, 1999 |
| 5,901,612 | Letovsky | May 11, 1999 |
| 5,909,925 | Glockl | Jun. 8, 1999 |
| 5,992,933 | West | Nov. 30, 1999 |
| 6,106,064 | Hibberd | Aug. 22, 2000 |
| 6,206,335 | Huber et al. | Mar. 27, 2001 |
| 6,068,280 | Torres | May 30, 2000 |
| 6,209,958 | Thole | Apr. 13, 2001 |
| 6,370,716 | Willeinson | Apr. 16, 2002 |
| 6,644,742 | Walser | Nov. 11, 2003 |
| 6,663,061 | Morris | Dec. 16, 2003 |
| 6,688,689 | Thorn | Feb. 10, 2004 |

In contrast, the following inventions provide for a rocking, balance, and variable resistance type exercises for the human extremities. These are believed to be the closest in structure to the present invention.

| U.S. Pat. No.: | | |
|---|---|---|
| 3,967,820 | Harper | Jul. 6, 1976 |
| 3,984,100 | Firster | Oct. 5, 1976 |
| 4,605,224 | Turii | Aug. 12, 1986 |
| 5,048,823 | Bean | Sep. 17, 1991 |
| 5,567,069 | Fay et al. | Oct. 22, 1996 |
| 5,897,474 | Romero | Apr. 27, 1999 |
| 6,019,712 | Duncan | Feb. 1, 2000 |
| 6,575,885 | Week et al. | Jun. 10, 2003 |

However, the above-noted prior art is deficient in one or more significant ways, either by providing a device with limited range of movement, providing a device that does not allow unrestricted motion of the lumbosacral pelvis, providing a device that only passively corrects improper spinal positioning, providing a device that does not provide for mobility of the lumbosacral spine, providing a device that passively positions its occupant in an anatomically correct position, providing a device that offers passive mobility to the lumbosacral spine in a side to side pattern instead of in unlimited directions, providing a device that does not create therapeutic exercise, providing a device that does not promote local intersegmental spinal motion for therapeutic benefit, providing a device that is not portable, providing a device that is not simple and easily manufactured in an inexpensive manner, providing a device that does not have simplicity and ease of use as well as manufacturing, providing a device that does not provide adequate stimulation of support structures in a seated or weighted position, providing a dynamic seat that promotes motion only in one plane, providing a therapeutic seat designed primarily for the relief of pressure to the genitourinary region of a seated user and not for spinal complex therapeutic exercise purposes, providing a seat that is limited in the directions of use, providing a seat that is not designed to sit on top of other seating surfaces, providing a seat that does not provide for rotation or flexion and extension of the lumbosacral spine, providing a seat that does not provide active dynamic mobility in unlimited directions even though it might have multiple adjustments, not providing a seat with an arc of motion that can be changed by a plurality of accessories to vary its height, angle of movement, arc of movement, and inherent stability, providing a therapeutic exercise device that does not allow change to its stability through use of accessory components designed to be utilized on various seating surfaces by an individual who will be seated while exercising and instead provides changes in stability through use of an inflatable device and variation in its pressure characteristics, and/or not providing a simple tool to relieve the buildup of spinal irritation to the soft tissues and allow the ability to compensate for and produce essential motion in the lumbosacral spine so as to reduce the experience of backaches and the other spinal pathologies typically associated with static sitting. There is no invention known with all of the features and advantages of the present invention.

BRIEF SUMMARY OF THE INVENTION

Objectives and Advantages

It is an object of the invention to provide a portable therapeutic seat exercise apparatus that provides a therapeutic effect to the support structures of the low back region while its user is engaged in other activities (occupational, recreational, relaxation, daily routines), as well as when the user decides to employ it to specifically perform an exercise session.

It is a further object of the present invention to provide a portable therapeutic seat exercise apparatus for improving low back stabilization, coordination, postural control, alignment, nutrition, proprioceptive awareness, and balance.

It is also the object of the present invention to provide a device that is able to optionally introduce varying amounts of instability into the seated environment so as to encourage response by the user's body that leads to development of its own stability through the strengthening, coordination, and proprioceptive requirements defined by the various configurations of the device.

Another object of the present invention is to provide a portable therapeutic seat exercise apparatus with a simple construction that can be readily manufactured and used.

It is also an object of the present invention to provide a portable therapeutic seat exercise apparatus that improves postural awareness, increases strength of postural muscles, and facilitates the maintenance of a neutral lordotic spine enabling persons to sit more erect and not slouch.

An additional object of the present invention is to provide a therapeutic exercise tool that is portable and useable on a variety of seats: at home (for dining and television viewing), in a school environment, in an office (such as a computer, desk, or executive chair), in a car or other motor vehicle, in the factory or on an assembly line, at sporting events, or even at picnics, etc.

It is also an object of the present invention to make a portable therapeutic seat exercise apparatus that is affordable for the intended consumer section.

Another object of the present invention is to provide a portable therapeutic exercise seat assembly that allows rocking back and forth, side-to-side motion; and the figure of eight, twisting, and pivoting motion that aids in developing movement in all areas of the low back region, as well as coordination, control, and strengthening of the postural control.

In addition, it is an object of the present invention to provide a portable therapeutic seat exercise apparatus with a contoured upper surface for anatomical protective seating comfort.

It is a further object of the present invention to provide a seating device capable of moving through an unlimited number of positions controlled by the pelvic, abdominal, low back, gluteal, and leg muscles of the occupant, with such movement encouraging dissipation of static forces, affecting a change in alignment, reducing pressure to the body, improving local circulation, strength, and nutrition; and enhancing neural control, particularly position senses.

It is also an object of present invention to assist drivers, wherein when the portable therapeutic seat exercise apparatus and method is utilized in a motor vehicle it provides the additional benefit of acting as a swivel seat attachment for the top of the automobile seat by means of which a person with back pain can move from a normal forward facing position to a side position with limited friction and not have to twist his or her spine during driving activity.

The portable therapeutic seat exercise apparatus of the present invention is a lightweight personal exerciser designed as a single unit for a person to improve their physical status. The apparatus consists of a contoured seat structure with arcuate hemispherical base configured for placement on seating surfaces. The seat structure and base can be permanently attached to one another, or separable for substitution of alternate bases or seats. When used as a seating apparatus it encourages and enhances low back and pelvic mobility rather than promoting the static nature of regular sitting. It also facilities low back stabilization and muscle toning, while reducing the risk of muscle and joint stiffness, as well as reducing the general deterioration and weakness associated with prolonged sitting. In the alternative, when used as an exercise device, the present invention apparatus provides the specific benefits of improving strength, coordination, flexibility, and conditioning by allowing range of motion, isometric, and isotonic training while its occupant is seated. There is no device known that has the same features and components as the present invention, nor all of its advantages.

BRIEF DESCRIPTION OF THE SEVERAL VIEWS OF THE DRAWINGS

FIG. 11 is a bottom view of a first hemispherical base member in the most preferred embodiment of the present invention with a central bore within its bottom surface, and which is used with the seat shown in FIGS. 1-10 to change the center of gravity of the seat and its occupant to the left, right, forward, or backward.

FIG. 12 is a side view of the first hemispherical base member in the most preferred embodiment of the present invention having an arcuate bottom surface and a protrusion extending outwardly beyond its opposing top surface.

FIG. 13 is a top view of the first hemispherical base member in the most preferred embodiment of the present invention having a centrally positioned upward protrusion, eight radially extending structural supports, and a circular support that intersects with the radially extending supports and is concentric in position to the upwardly extending protrusion.

FIG. 14 is a top perspective view of the first hemispherical base member in the most preferred embodiment of the present invention with one centrally positioned upward protrusion, eight radially extending structural supports, and a circular support that intersects with the radially extending supports and is concentric to the upwardly extending protrusion.

FIG. 15 is a sectional side view of the first hemispherical base member in the most preferred embodiment of the present invention, with the section taken along line A-A in FIG. 13 and the first hemispherical base member having one centrally positioned upward protrusion that extends in part beyond the plane of its top perimeter, a centrally positioned bottom bore positioned beneath the protrusion, and opposing portions of the circular support at evenly spaced-apart distances from the centrally located protrusion and bore.

FIG. 16 is a bottom view of a second hemispherical base member in the most preferred embodiment of the present invention used alone with the seat in FIGS. 1-10, or in combination with the first base member and the seat, to further change the center of gravity of the seat and its occupant to the left, right, forward, or backward, with the second base member having has a central bore within its bottom surface FIG. 17 is a side view of the second hemispherical base member in the most preferred embodiment of the present invention having an arcuate bottom surface but without any protrusion extending upwardly beyond its opposing top surface.

FIG. 18 is a top view of the second hemispherical base member in the most preferred embodiment of the present invention having a centrally positioned upward protrusion, four radially extending structural supports, and a circular support that intersects with the radially extending supports and is concentric to the upwardly extending protrusion.

FIG. 19 is a top perspective view of the second hemispherical base member in the most preferred embodiment of the present invention having a centrally positioned upward protrusion, four radially extending structural supports, and a circular support that intersects with the radially extending supports and is concentric to the upwardly extending protrusion.

FIG. 20 is a side view of the second hemispherical base member in the most preferred embodiment of the present invention with the section taken along line A-A in FIG. 18 and the second hemispherical base member having one centrally positioned upward protrusion that does not extend beyond the plane of its top perimeter, a centrally positioned bottom bore beneath the protrusion, two visible radially extending structural supports, and opposing portions of the circular support that intersects with the radially extending supports and which are at a uniform spaced-apart distance from the centrally located protrusion and bore.

FIG. 21 is a sectional side view of the second hemispherical base member in the most preferred embodiment of the present invention with the section taken along line B-B in FIG. 18 and the second hemispherical base member having one centrally positioned upward protrusion that does not extend beyond the plane of its top perimeter, a centrally positioned bottom bore beneath the protrusion, two opposed radially extending structural supports, and a portion of the circular support that intersects with the radially extending supports and is concentric to the centrally located protrusion and bore.

FIG. 22 is a bottom view of first preferred configuration of insert used in the most preferred embodiment of the present invention with the insert having a cluster of bores centrally within its bottom surface, including a center bore.

FIG. 23 is a side view of the first preferred configuration of insert used in the most preferred embodiment of the present invention with the insert having a substantially uniform thickness dimension and several centrally upstanding connecting members extending beyond its top surface.

FIG. 24 is a top view of the first preferred configuration of insert used in the most preferred embodiment of the present invention with the insert having a centrally positioned cluster of upstanding connecting members that includes a center connecting member, a circular support around the connecting members that is concentric to the center connecting member, and twelve radially extending structural supports between the circular support and the insert perimeter.

FIG. 25 is a top perspective view of one possible configuration of insert used in the most preferred embodiment of the present invention with the insert having a centrally located cluster of upstanding connecting members, a circular support around the connecting members that is concentric to the center connecting member, and twelve radially extending structural supports connected between the circular support and the insert perimeter.

DETAILED DESCRIPTION OF THE INVENTION

Figure 1:
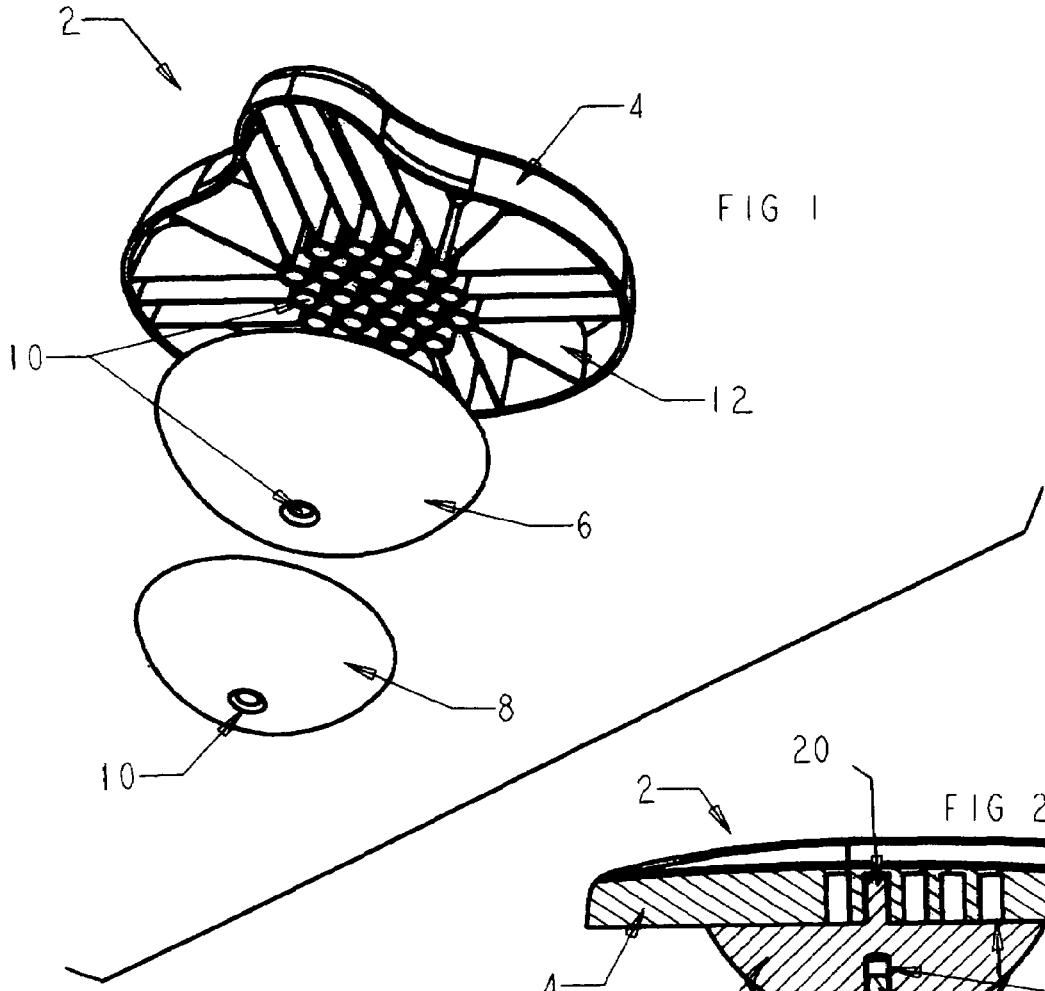
FIG. 1 is a bottom exploded view of the most preferred embodiment of the present invention having a seat with multiple centrally located attachment points and a plurality of structural supports between the attachment points and its perimeter, a first hemispherical base member used to change the center of gravity of an occupant of the seat to the left, right, forward, or backward, and a second hemispherical base member used alone with the seat or in combination with the first base member to further change the center of gravity of a seat occupant to the left, right, forward, or backward, with both base members having a bore centrally within its bottom surface.

The present invention is a portable therapeutic seat exercise apparatus 2 and method for its use that provide a lightweight personal exerciser designed for a person (not shown) to use to improve his or her physical status, and for the exercise, alignment, and stress reduction of a person's trunk, spine, abdomen, pelvis, and thighs. The present invention encourages and enhances low back mobility in place of the static nature of regular sitting. It also has a lightweight contoured seating surface 4 supported by at least one arcuate hemispherical base 6, or other base such as but not limited to base 8, that allows unrestricted motion in all directions, including twisting, tilting, rocking, pivoting, and figure eight motion. For greatest versatility, contoured seating surface 4 would be separable from base 6, or other supporting base and/or accessory combination such as but not limited to base 8 and insert 22, so that a user can adapt the present invention for a variety of therapeutic and exercise applications. However, in the alternative and for a specific application, it is also contemplated for the scope of the present invention to include supporting bases and/or accessories that are permanently attached to contoured seating surface 4 or a variation thereof. When separable and as shown in the accompanying illustrations, one possible way in which to accomplish the needed attachment during use between contoured seating surface 4 and base 6 or other accessories, is for seating surface 4 to have at least one vagination or bore 10 in its bottom surface (hereinafter arbitrarily referred to as 'bore' for concise designation), or perhaps a cluster of bores 10, and for base 6 and the other accessories to have at least one protrusion 20 extending from its top surface, with each protrusion 20 having a configuration that complements the bores 10 in seating surface 4 for secure attachment of one to the other. In the reverse, although not shown, one or more bores 10 could be in the top surface of base 6 and at least one protrusion 20 could extend downwardly from the bottom surface of seating surface 4 with each protrusion 20 having a configuration that complements the bores 10 in base 6 for secure attachment of one to the other. Having multiple bores 10 in base 6 would allow a smaller seating surface 4, if desired. No additional snap-fit connection or locking means, other than bores 10 and protrusions 20, would be required for safe and effective use of the present invention as bores 10 and protrusions 20 are sufficient in length so that the weight of an occupant prevents separation of seating surface 4, base 6, and/or other accessories from one another during occupant use. However, it must be understood that the means of attachment between seating surface 4, base 6, and any other accessories used to vary the height, depth, position, and arc of the present invention configuration is not critical and not limited to the bores 10 and protrusions 20 shown in the accompanying illustrations, and other attachment means that allow the present invention to achieve the same functions are also considered to be within its scope. In many applications, base 6 forms the primary support for the rocking, pivoting, wobbling, and other movement of seating surface 4 and its occupant (not shown), and it can be placed on many seating surfaces (not shown) including but not limited to the upper surface of sofas, dining chairs, school desk chairs, office chairs, chairs employed during computer use, factory benches, picnic benches, and motor vehicle seats. The use of therapeutic seat exercise apparatus 2 facilitates low back muscular stabilization, conditioning, strengthening, coordination, and enhancement of proprioceptive senses. The occupant's effort to maintain stability while seated upon therapeutic seat exercise apparatus 2 forces development of postural muscles, including the protected spinal stabilizing back muscles that otherwise undergo little stress or stimulation. Portable therapeutic seat exercise apparatus 2 uses accessory attachments, such as but not limited to those identified by the numbers 8 (and referred to as "smaller hemispherical base" or "second hemispherical base") and 22 (referred to as "disk-shaped insert" or "insert"), to vary the height, depth, position, and arc of the combined supporting structure for contoured seating surface 4 so as to offer unrestricted mobility to the lumbosacral spine in any direction. While FIGS. 1-10 show a preferred structure for seating surface 4, FIGS. 11-16 show a preferred structure for first hemispherical base 6, FIGS. 16-21 show a preferred structure for second hemispherical base 8, and FIGS. 22-25 show a preferred structure for an insert 22 usable between seating surface 4 and base 6, the present invention also includes other seat, base, and accessory embodiments that are not shown in the accompanying illustration, and which can be used alone, in combination with one another, or in combination with seating surface 4 and/or base 6, as long as they assist in changing the center of gravity or range of motion of an occupant to the left, right, forward, or backward, or while the occupant is otherwise conducting rocking tilting, rotation, and/or wobbling motion. Thus, the scope of the present invention should be determined by the appended claims and not limited to the examples provided herein.

FIG. 1 shows most preferred embodiment 2 of the present invention having an upper seating surface 4, a lower second hemispherical base 8, and a first hemispherical base 6 positioned between upper seating surface 4 and lower second hemispherical base 8. First hemispherical base member 6 and second hemispherical base member 8 are both used to change the center of gravity of a seating surface 4 occupant to the left, right, forward, or backward, and each can be used alone with seating surface 4, in combination with one another and seating surface 4, in combination with seating surface 4 and other accessories such as but not limited to the insert 22 shown in FIGS. 21-25, and/or in combination with one another, one or more accessories, and seating surface 4. First hemispherical base 6 and second hemispherical base 8 are each oriented with its arcuate surface remote from seating surface 4, and each also has one bore 10 centrally located through its arcuate bottom surface. The limiting factor in selecting a configuration for first hemispherical base 6, lower second hemispherical base 8, or substitute accessory or base (not shown) is its effectiveness in developing postural muscles, particularly the protected spinal stabilizing back muscles that otherwise receive little stress or stimulation. The number of bores 10 used is not critical, and two or more bores 10 may alternatively be used in first hemispherical base 6, second hemispherical base 8, and other present invention bases (including oval and elliptical, although not shown), even though it is preferred for most applications that a central bore 10 remains present. FIG. 1 also shows the bottom of seating surface 4 having multiple centrally located bores 10 which serve as alternative attachment points for base 8, base 6, insert 22, and other accessories (that are similar in function to base 8, base 6, insert 22), and which can be used to vary the height, depth, position, and arc of the combined supporting structure for contoured seating surface 4 so as to offer unrestricted mobility in any direction to the lumbosacral spine of an occupant seated upon the top of seating surface 4. In the alternative, one or more bores 10 could be in the top surface of base 6 and at least one protrusion 20 could extend downwardly from the bottom surface of seating surface 4 with each protrusion 20 having a configuration that complements the bores 10 in base 6 for secure attachment of one to the other. Further, the size and configuration of seating surface 4 is not critical, and having multiple bores 10 in base 6 would allow a smaller seating surface 4 than is shown in FIG. 1, if desired. FIG. 1 further shows seating surface 4 having approximately twenty structural supports 12 positioned between bores 10 and the seat perimeter. The configuration, thickness dimension, positioning, number, and materials used for structural supports 12 can vary from that shown as long as sufficient support is provided for seating surface 4 to enhance occupant comfort during extended therapeutic and exercise use.

Figure 2:
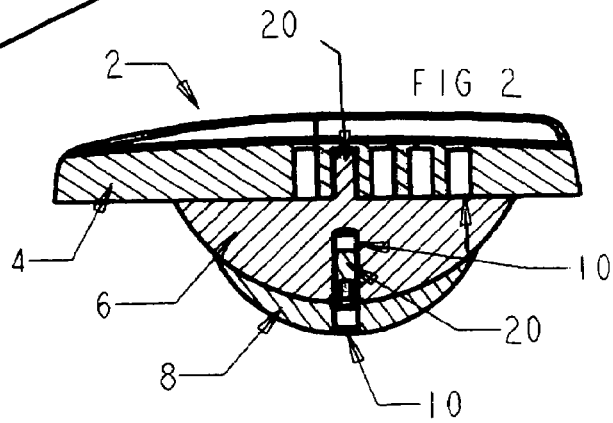
FIG. 2 is a sectional side view of the most preferred embodiment of the present invention in an assembled configuration with the second hemispherical base member engaging the bottom surface of the first base member, which is shown engaging the bottom of the seat, with an upward protrusion from the second base member being inserted into the central bore within the bottom surface of the first base member, and an upward protrusion from the first base member being inserted into one of the central bores within the bottom surface of the seat.
Figure 3:
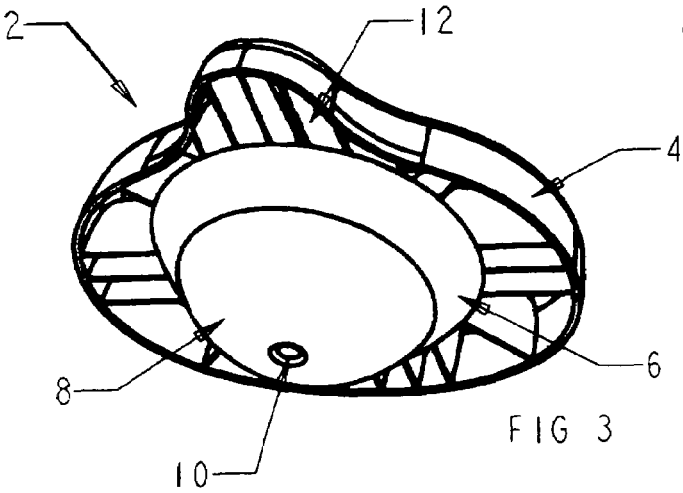
FIG. 3 is a bottom perspective view of the most preferred embodiment seat supported upon a substantially hemispherical first base member, and the first base member being supported upon a substantially hemispherical second base member base that has a bore centrally within its bottom surface.

FIGS. 2 and 3 respectively show side and bottom views of most preferred embodiment 2. FIG. 2 shows an assembled configuration with second hemispherical base member 8 engaging the bottom surface of first base member 6, which is shown engaging the bottom of seating surface 4. An upward protrusion 20 from second base member 8 is inserted into the central bore 10 in the bottom surface of first base member 6, and an upward protrusion 20 from first base member 6 is inserted into one of several bores 10 within the bottom of seating surface 4. FIG. 2 shows first base member 6 having a greater height dimension than second base member 8 and a close fitting connection between first base member 6 and second base member 8, with no gap, insert 22, or other structure therebetween. Although first base member 6 and second base member 8 are shown to be symmetrical in configuration and substantially hemispherical, other bases including those with an elliptical cross-sectional configuration and asymmetrical configurations are also contemplated to be within the scope of the present invention for additional therapeutic applications. While FIG. 3 shows first base member 6 in contact with a substantial portion of the bottom of seating surface 4, it is to be understood that the amount of such contact may vary as long as the height dimension of first base member 6, second base member 8, and/or other accessories or accessory/base in combination is sufficient to prevent the perimeter of seating surface 4 from striking any portion of its support surface and thereby impeding the full range of motion needed for effective therapeutic and exercise use of the present invention. When the discussion herein mentions insertion of a protrusion 20 into a bore 10, unless stated otherwise it is to be assumed that such language includes the insertion of a protrusion 20 into any bore 10 present on first base member 6, second base member 8, or seating surface 4, and not just a centrally located bore 10. Since the occupant's weight provides a downward force against the connection of accessories to first base member 6 and second base member 8, as well as each to seating surface 4, the accessories employed to change the radius of curvature for muscle developing movement do not require a threaded or snap-fit engagement, although such engagement could be used and is also considered to be within the scope of the present invention. Instead, the connection of accessories, such as but not limited to insert 22 shown in FIGS. 22-25, can be a simple and easily reversible insertion of a protrusion 20 into a bore 10. However, a close fit within bore 10 should be provided for protrusion 20 to prevent significant lateral movement of protrusion 20 while it is within bore 10 during use to provide a smooth arc of motion for an occupant of the attached seating surface 4. Further, first base member 6 and second base member 8 can be made from any rigid and durable material, including but not limited to smooth plastic, wood, metal, as long as it is configured to provide a smooth arc of motion, does not deform under the weight of an occupant positioned upon seating surface 4, and continues to provide its original unstable configuration during the entire period of rocking, pivoting, and other muscle stimulating movement conducted by an occupant positioned in seating surface 4. In contrast, although portions of seating surface 4 may also be constructed from wood, plastic, and metal, seating surface 4 must also comprise materials with a soft consistency capable of effectively producing the needed contours and motion requirements.

Figure 4:
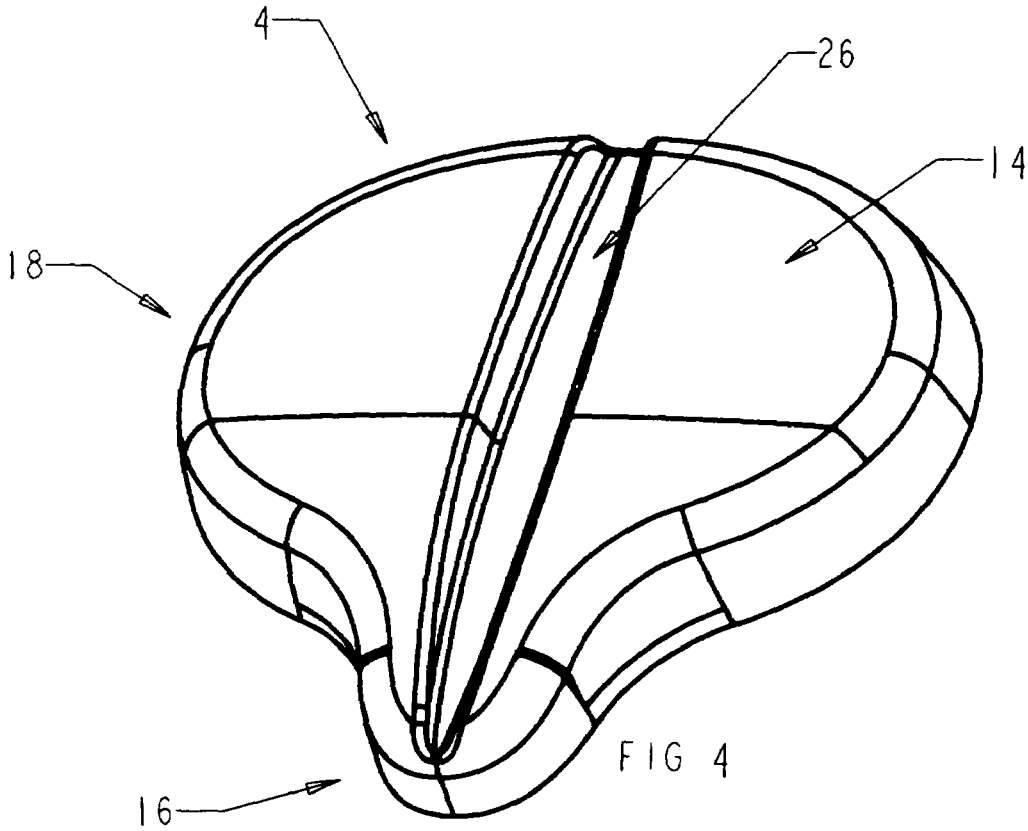
FIG. 4 is a top view of the seat in the most preferred embodiment of the present invention having a contoured upper surface with a centrally extending front-to-back vagination, a narrowed front portion, and a substantially wider rear portion, configured in combination for the anatomical protective seating comfort of a user.

As can be seen in FIG. 4, seating surface 4 also has upper surface contours, including a centrally extending longitudinal vagination 26 that is comfortably configured to accommodate pelvic anatomical structure. Additionally, the centrally extending longitudinal vagination 26 in the top of seating surface 4 is also configured to provide a relief area while seating surface 4 is in a compressed state during use to result in relief of pressure to the occupant's buttock, genitalia, and posterior thigh regions. However, although the relative sizes and configurations of seating surface 4, bores 10, structural supports 12, vagination 26, base 6, and base 8 shown in FIGS. 1-4 are preferred, they are not critical and embodiments having seating surface 4, bores 10, structural supports 12, vagination 26, base 6, and base 8 with other shapes and dimensions not shown, but which can function similarly in place thereof, are also considered to be within the scope of the present invention. Also, the width and depth of the vagination 26 shown in FIG. 4 can be varied during manufacture according to the approximate size and weight of the occupants (not shown) contemplated for use of seating surface 4. FIG. 4 also shows the widest lateral portion of seating surface 4 marked with the number 18, and the top of seating surface 4 having a front portion 16 and a back portion 14. Although FIG. 4 shows vagination 26 narrowing in width dimension at each of its ends, the inward tapering of vagination 26 in front portion 16 is greater than that occurring in the back portion 14 of seating surface 4. Also, as can be viewed in FIG. 7, the front portion 16 of seating surface 4 on each side of vagination 26 gradually narrows in height as it slopes toward the front perimeter edge of seating surface 4, while the thickness dimension of back portion 14 on each side of vagination 26 remains substantially the same. The widest lateral portion 18 of seating surface 4 is included for illustrative purposes as apart of back portion 14, and has a substantially uniform thickness dimension, as shown in FIG. 8. Although not limited thereto, it is preferred for seating surface 4 to be wide so as to create more contact area between an occupant and seating surface 4, and comprise gel or other supportive materials that are resilient and yielding, with a soft consistency for continued occupant comfort during extended use. The contour of the top of seating surface 4 must also be comfortable for the occupant. In addition, the material used to cover seating surface 4 should be washable so that it can be periodically cleaned and/or sanitized. Further, all materials used for seating surface 4 should be durable for extended use. Use of materials with elastic properties to cover seating surface 4 is considered within the scope of the present invention, although not critical. An occupant of seating surface 4 is typically anchored and balanced by his or her feet while using the present invention for muscle-developing motion.

Figure 5:
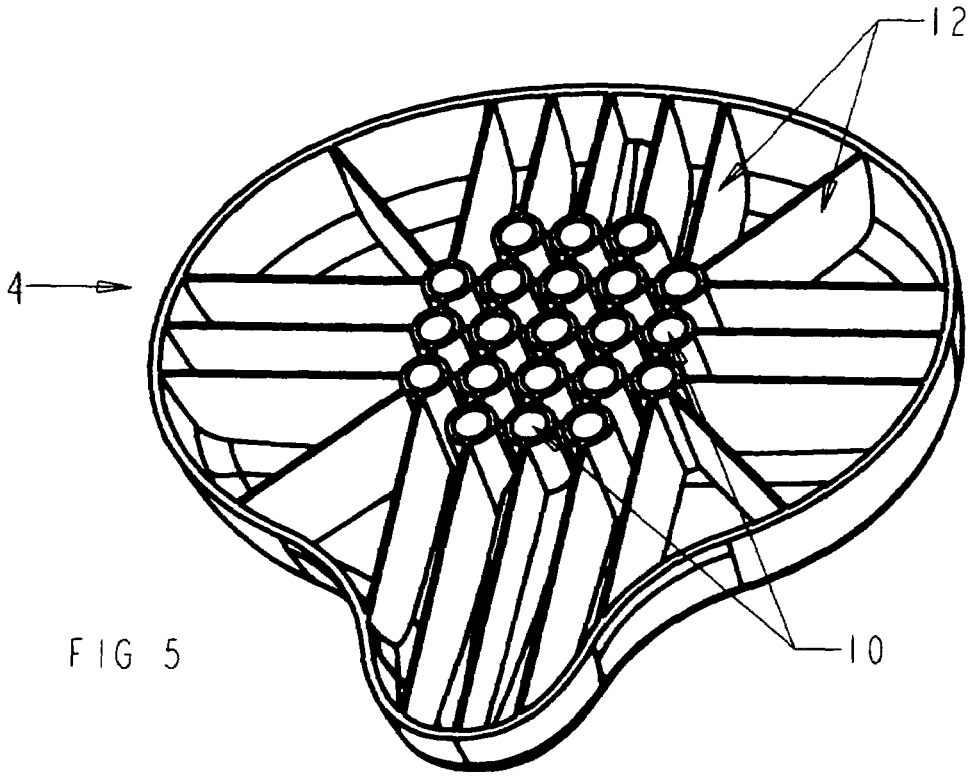
FIG. 5 is a bottom perspective view of the seat in the most preferred embodiment of the present invention having multiple centrally located attachment points and a plurality of structural supports positioned between the attachment points and the seat perimeter.
Figure 6:
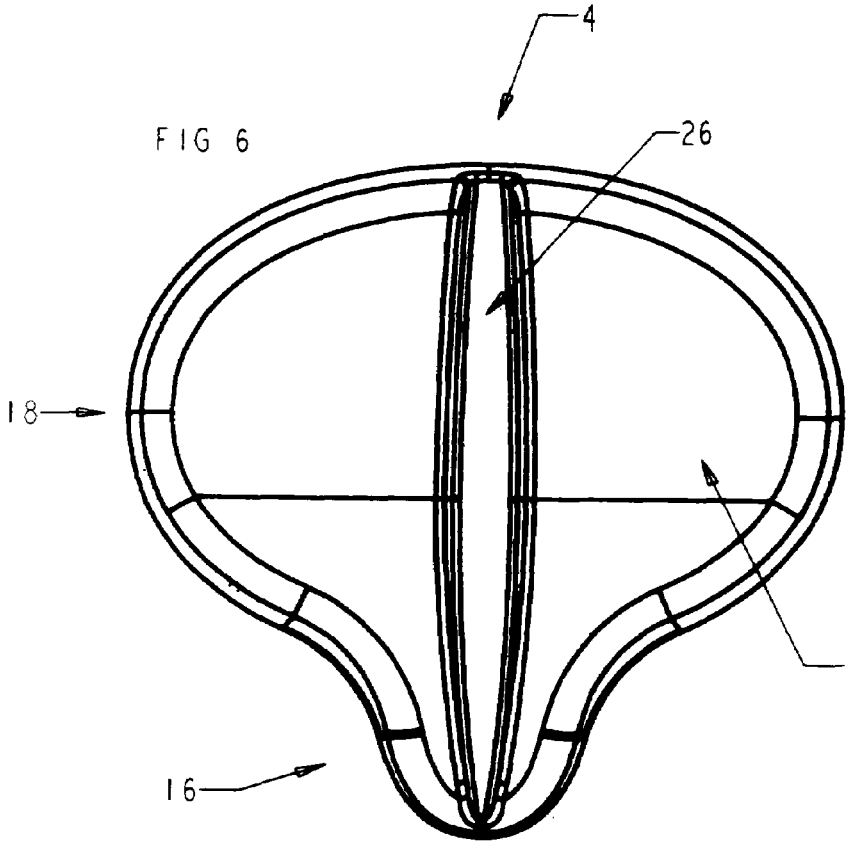
FIG. 6 is a top view of the seat in the most preferred embodiment of the present invention having a front-to-back vagination that extends substantially the full length of the seat.
Figure 7:
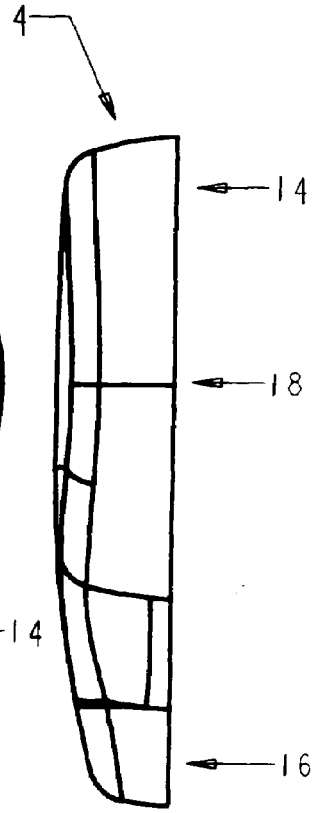
FIG. 7 is a side view of the seat in the most preferred embodiment of the present invention having a rear portion surrounding its central vagination that has a substantially uniform front-to-back thickness, and a front portion with a tapering distal end thickness dimension.
Figure 8:
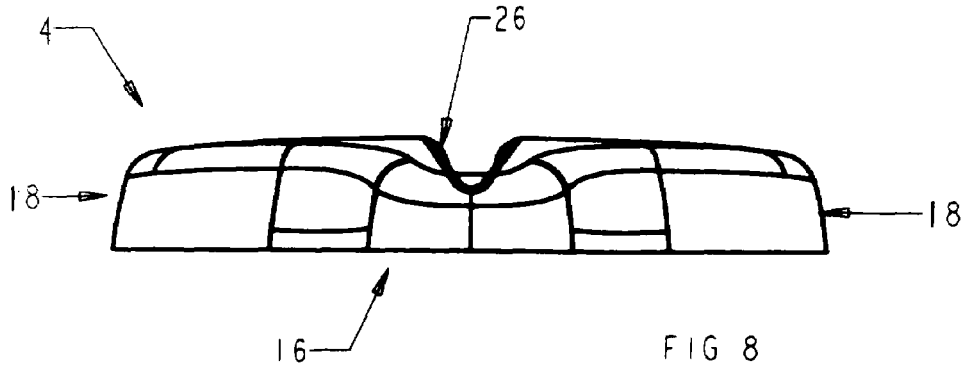
FIG. 8 is a front view of the seat in the most preferred embodiment of the present invention having a slightly tapered surface configuration that angles laterally downward from the central vagination in opposing directions.
Figure 9:
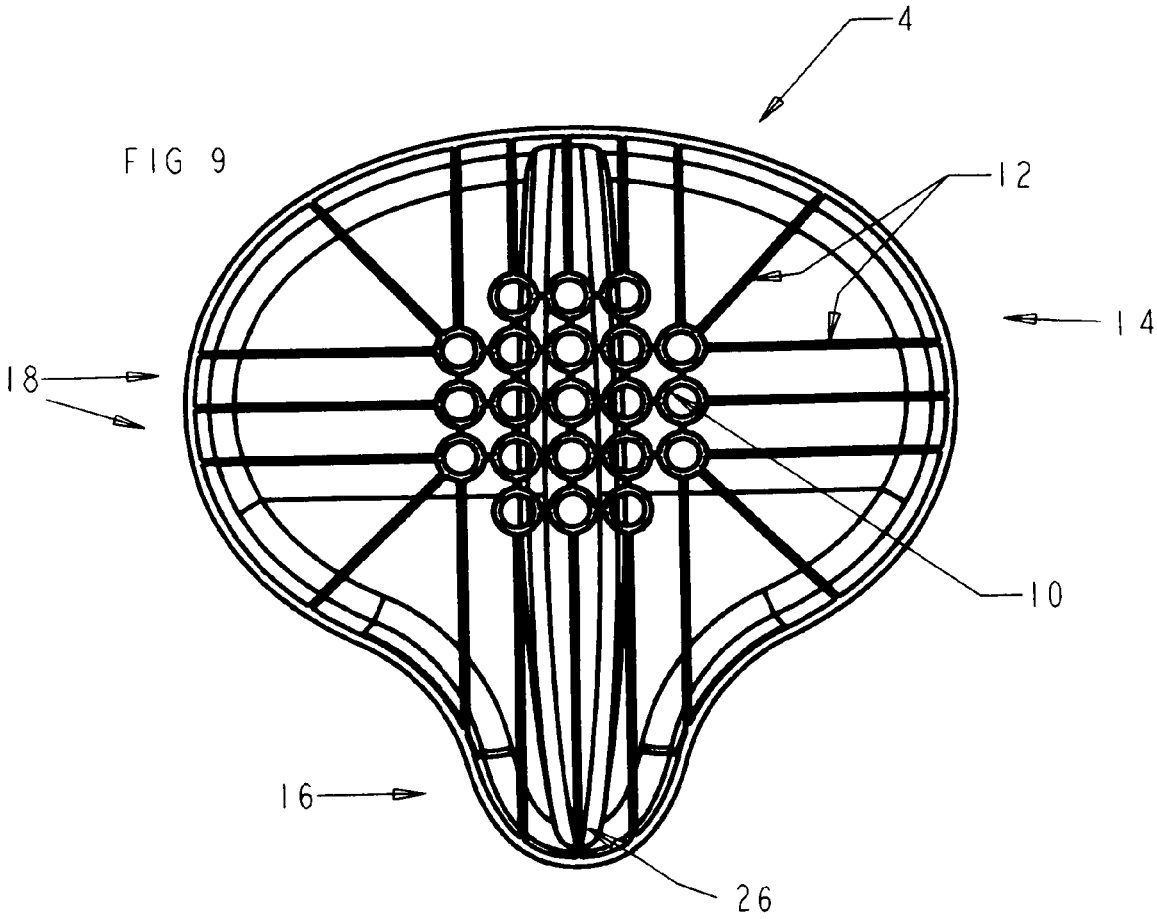
FIG. 9 is a bottom view of the seat in the most preferred embodiment of the present invention having multiple centrally located attachment points symmetrically positioned laterally relative to the central vagination and structural supports positioned vertically, horizontally, and diagonally between the attachment points and the seat perimeter.
Figure 10:
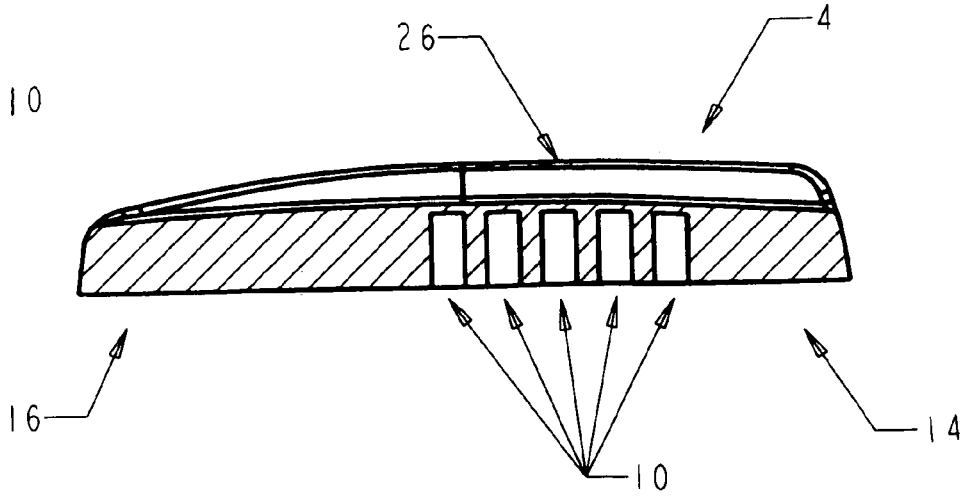
FIG. 10 is a sectional side view of the seat in the most preferred embodiment of the present invention with the section taken centrally along the longitudinal axis of the seat and the seat having a central vagination, a rear portion that has a substantially uniform front-to-back thickness, and a front portion with a tapering distal end thickness dimension.

FIGS. 5-10 show additional views of the most preferred structure of seating surface 4. FIG. 5 shows the bottom of seating surface 4 in the most preferred embodiment of the present invention having multiple centrally located attachment bores 10 and a plurality of structural supports 12 positioned between the bores 10 and the outside perimeter of seating surface 4. The number of bores 10 and structural supports 12 used is not critical, and one bore 10 may be present with twelve or more structural supports 12, or in the alternative as another example, the bottom of seating surface 4 may have only bore 10 and no structural supports 12. The length and width dimensions of structural supports 12, when used, can vary from that shown in FIG. 5, and structural supports 12 may be intersecting with one another, even though the structural supports 12 shown in FIG. 5 all appear to be radiating outwardly from the central cluster of bores 10. Also, the diameter dimensions of bores 10 may vary from that shown, as long as the diameters of and bores 10 used is proportioned for secure mating with protrusions 20, with or without one or more permanent or removable adapters (not shown) configured to increase the diameter dimension of protrusion 20 or reduce the diameter dimension of a bore 10 targeted for its mating engagement. FIG. 6 shows the top of seating surface 4 in the most preferred embodiment of the present invention having a front-to-back vagination 26 that extends substantially the full length of seating surface 4 and is laterally symmetrical. FIG. 6 also shows vagination 26 narrowing in width dimension at each of its ends and having its widest dimension in the approximate area where the front portion of seating surface 4 begins to angle downwardly toward its front perimeter edge. The inward tapering of vagination 26 in front portion 16 is greater than that occurring in the back portion 14 of seating surface 4. The widest lateral portion 18 of seating surface 4 is included for illustrative purposes as apart of back portion 14, and does not have a forward slope, as confirmed in FIG. 7. FIG. 7 shows seating surface 4 in the most preferred embodiment of the present invention having a rear portion 14 on either side of its central vagination 26 with a substantially uniform thickness throughout, including the widest lateral portion 18 of seating surface 4. FIG. 7 also shows seating surface 4 having a front portion 16 with a gradually narrowing thickness dimension. FIG. 8 shows seating surface 4 in the most preferred embodiment of the present invention having a central vagination 26 that extends substantially to the front perimeter edge of front portion 16. FIG. 8 also shows seating surface 4 having a very slightly tapered surface configuration that angles laterally downward in opposing directions from a highest thickness dimension adjacent to central vagination 26 toward areas marked by the number 18 as the widest lateral portion of seating surface 4. FIG. 9 shows seating surface 4 in the most preferred embodiment of the present invention having multiple centrally located attachment bores 10 symmetrically positioned laterally relative to the central vagination 26 and structural supports 12 positioned vertically, horizontally, and diagonally between bores 10 and the perimeter edges of seating surface 4. The number of bores 10 is not critical and can be as few as one, which is not required to be centrally located. Further, seating surface 4 may have protrusions 20 instead of bores 10, which would then become a part of first base member 6, second base member 8, and accessories such as but not limited to insert 22. Alternative quick-release connection means is also contemplated by the present invention for connecting seating surface 4 with first base member 6, second base member 8, and/or any other accessories used to alter the arc of motion for the occupant (not shown) of seating surface 4. The symmetrical positioning of bores 10 is not critical and the number, size, and positioning of bores 10 relative to vagination 26 may be different from that shown in FIG. 9, depending upon the targeted therapeutic or other use of the present invention. Most of the bores 10 shown in FIG. 9 are in the area of back portion 14 that is marked by the number 18 as the widest lateral portion of seating surface 4, with only three bores 10 being positioned close to or within the forwardly sloping front portion 16 of seating surface 4. The length and width dimensions of structural supports 12 can also vary from that shown in FIG. 9, and structural supports 12 may be intersecting with one another, even though the structural supports 12 shown in FIG. 9 all appear to be radiating outwardly from the central cluster of bores 10. FIG. 10 shows seating surface 4 in the most preferred embodiment of the present invention in a sectional view taken centrally along its longitudinal axis. FIG. 10 further shows the front portion 16 of seating surface 4 gradually diminishing in height dimension toward its front perimeter edge, central vagination 26 extending substantially the full length of seating surface 4, a back portion 14 that has a substantially uniform thickness dimension, and bores 10 being positioned substantially under the back portion 14 of seating surface 4 where the thickness dimension remains substantially uniform.

FIGS. 11-15 show first base member 6 configured to change the arc of motion for seating surface 4. It can be used alone with seating surface 4; with seating surface 4 and second base II member 8; with seating surface 4 and insert 22; with seating surface 4, insert 22, and second base member 8; or with varying combinations of seating surface 4, insert 22, second base member 8, and other accessories (not shown), such as but not limited to oval and/or elliptical base members that can also be used individually and in any combination to vary the height, angle of movement, arc of movement, center of gravity, and inherent stability of seating surface 4, thereby promoting a more active and dynamic therapeutic exercise for the occupant of seating surface 4. Since first base member 6 is provided merely as an example of how accessories may be used with seating surface 4 to provide forward movement, backward movement, lateral movement, and movement in any other direction, including circular, semi-circular, and figure-eight movement, the configuration of its perimeter is not limited to that shown, and it is contemplated for base member 6 to also be larger, smaller, and/or have a different perimeter arc than is shown in FIGS. 11-15. FIG. 11 shows the outside bottom surface view of first base member 6 in the most preferred embodiment of the present invention having a central bore 10. However, the location of bore 10 is not limited to a central location and can be anywhere that will change the center of gravity of seating surface 4 into an orientation that challenges an occupant's muscles to maintain the occupant in a balanced position while he or she is anchored by one or both feet. FIG. 12 shows first base member 6 having a hemispherical configuration and a protrusion 20 extending centrally beyond its non-arcuate perimeter. The location of protrusion 20 is not limited to a central location and can also be anywhere that changes the center of gravity of seating surface 4 into an orientation that challenges an occupant's muscles to continually maintain a balanced position. FIG. 13 shows first hemispherical base member 6 having a centrally positioned protrusion 20, eight radially extending structural supports 12, and a circular support structure 40 that intersects with the radially extending supports 12 and is concentric in position to the upwardly extending protrusion 20. More than one circular support 40 can be present, and additional structural supports 12 that extend between existing structural supports 12, as well as between structural supports 12 and one or more circular supports 40, are also contemplated as being within the scope of the present invention. The thickness dimension of structural supports 12 and circular supports 40 may also be different from that shown in FIG. 13. FIG. 14 shows the first hemispherical base member 6 in the most preferred embodiment of the present invention with one centrally positioned upwardly directed protrusion 20, eight radially extending structural supports 12, and a circular support 40 that intersects with the radially extending supports 12 and is concentric to the upwardly extending protrusion 20. If seating surface 4 is provided with male connecting means, including that similar to protrusion 20, then it is contemplated for a bore 10 configured for secure engagement with the male connecting means to replace the central protrusion 20 shown in FIG. 14. Further, although the height dimension of circular support 40 appears in FIG. 14 to be substantially similar to that of structural supports 12, the height dimension of circular support 40 may also be greater or less than that of structural supports 12. FIG. 15 shows first hemispherical base member 6 in the section taken along line A-A in FIG. 13. Bore 10 extends upwardly through the bottom surface of first base member 6, and a portion of circular support 40 appears on both sides of bore 10. In addition, protrusion 20 is aligned with and in a position superior to bore 10, with bore 10 not extending fully through first base member 6. It is contemplated for bore 6 to also have a length dimension greater and smaller than that shown in FIG. 15, the length dimension of bore 10 should be sufficient to securely fix a protrusion 20 therein during occupant use of seating surface 4. Protrusion 20 extends in part beyond the plane of the non-arcuate top perimeter of first base member 6. The amount of protrusion extending beyond the plane of the non-arcuate top perimeter of first base member 6 may vary from that shown in FIG. 15.

FIGS. 16-21 shows second base member 8 configured to change the arc of motion for seating surface 4, seating surface 4 in combination with first base member 6; seating surface 4 and insert 22; seating surface 4, insert 22, and first base member 6; or with varying combinations of seating surface 4, insert 22, first base member 6, and other accessories (not shown), such as but not limited to oval and/or elliptical base members that can also be used individually and in any combination to vary the height, angle of movement, arc of movement, center of gravity, and inherent stability of seating surface 4, thereby promoting a more active and dynamic therapeutic exercise for the occupant of seating surface 4. The configuration of second base member 8 is not limited to that shown, and it is contemplated for base member 6 to also be larger, smaller, and/or have a different perimeter arc than is shown in FIGS. 16-21. FIG. 16 shows the outside bottom surface view of second base member 8 in the most preferred embodiment of the present invention having a central bore 10. However, the location of bore 10 is not limited to a central location and can be anywhere that will change the center of gravity of seating surface 4 into an orientation that challenges an occupant's muscles to maintain the occupant in a balanced position while he or she is anchored by one or both feet. FIG. 17 shows second base member 8 having a hemispherical configuration but no protrusion 20 extending beyond its non-arcuate perimeter, as was found in first base member 6 (see FIG. 12). FIG. 18 shows second hemispherical base member 8 having a centrally positioned protrusion 20, four radially extending structural supports 12, and a circular support structure 40 that intersects with the radially extending supports 12 and is concentric in position to the upwardly extending and centrally located protrusion 20. More than one circular support 40 can be present, and additional structural supports 12 that extend between existing structural supports 12, as well as between structural supports 12 and one or more circular supports 40, are also contemplated as being within the scope of the present invention. The thickness dimension of structural supports 12 and circular supports 40 may also be different from that shown in FIG. 18. The location of protrusion 20 is not limited to a central location and can also be secured anywhere within second base member 8 that changes the center of gravity of seating surface 4 into an orientation that challenges an occupant's muscles to continually maintain a balanced position. FIG. 19 shows the second hemispherical base member 8 in the most preferred embodiment of the present invention with one centrally positioned upwardly directed protrusion 20, four radially extending structural supports 12, and a circular support 40 that intersects with the radially extending supports 12 and is concentric to the upwardly extending protrusion 20. If seating surface 4 is provided with male connecting means, including that similar to protrusion 20, then it is contemplated for a bore 10 configured for secure engagement with the male connecting means to replace the central protrusion 20 shown in FIG. 19. Further, although the height dimension of circular support 40 appears in FIG. 19 to be substantially similar to that of structural supports 12, the height dimension of circular support 40 may also be greater or less than that of structural supports 12. FIG. 20 shows second hemispherical base member 8 in the section taken along line A-A in FIG. 18. Bore 10 extends upwardly through the bottom surface of second base member 8, and a portion of circular support 40 appears on both sides of bore 10. In addition, protrusion 20 is aligned with and in a position superior to bore 10, with bore 10 not extending fully through second base member 8. It is contemplated for bore 6 to also have a length dimension greater and smaller than that shown in FIG. 15. However, the length dimension of bore 10 should be sufficient to securely fix a protrusion 20 therein during occupant use of seating surface 4. Protrusion 20 does not extend beyond the plane of the non-arcuate top perimeter of second base member 8. In the alternative, a portion of protrusion 20 can be made to extend beyond the plane of the non-arcuate top perimeter of second base member 8. FIG. 21 shows second hemispherical base member 8 in section taken along line B-B in FIG. 18 and second hemispherical base member 8 having one centrally positioned upward protrusion 20 that does not extend beyond the plane of its top perimeter, a centrally positioned bottom bore 10 beneath the protrusion 20, two opposed radially extending structural supports 12, and a portion of the circular support 40 that intersects with the radially extending supports 12 and is concentric to the centrally located protrusion 20 and bore 10.

FIGS. 22-25 show an example of one of the accessories, an insert 22, that is usable with the present invention seating surface 4. FIG. 22 shows insert 22 having a cluster of bores 24 centrally within its bottom surface, including a center bore 28. The cluster of bores 24 may be larger or smaller than is shown in FIG. 22. Also, the positioning of the cluster of bores 24 in FIG. 22 may be different than shown. Further, although center bore 28 is preferred, its use is not critical. FIG. 23 shows insert 22 having a substantially uniform thickness dimension and several centrally upstanding connecting members extending beyond its top surface, that are extensions of the structure 24 and 28, respectively, that define the closed ends of the cluster of bores 24 and center bore 28. FIG. 24 shows insert 22 having a centrally positioned cluster of upstanding connecting members that are extensions of the structure 24 that defines the closed ends of the cluster of bores 24, a center connecting member that is an extension of the structure that defines the closed end of center bore 28, a circular support 40 around the connecting members 24 and 28 that is concentric to the center connecting member 28 and twelve radially extending structural supports 12 between the circular support and the perimeter of insert 22. More than one circular support 40 may be used, and the number of structural supports 12 used may be more or less than that shown in FIG. 24. FIG. 25 shows insert 22 having a centrally located cluster of upstanding connecting members 24 and 28, a circular support 40 around the connecting members 24 and 28 that is concentric to the center connecting member 28, and twelve radially extending structural supports 12 connected between the circular support 40 and the perimeter of insert 22. The thickness dimensions of circular support 40 and structural supports 12 may vary from that shown in FIG. 25. Also, although the thickness dimensions of circular support 40 and all structural supports 12 is shown in FIG. 25 is substantially uniform, such uniformity is not critical.

It is not critical whether any accessory, such as but not limited to second base member 8 or insert 22, completely fits over first base member 6, or leaves some portion of first base member 6 visible while it is in its useable position, as shown in FIG. 1. The cluster of bores 24 shown in FIGS. 24 and 25 accept the attachment of a variety of accessories in multiple positions so as to increase the range of motion for an occupant (not shown) positioned upon seating surface 4. Thus, a single accessory such as but not limited to second base member 8 or insert 22, may be able to shift the center of gravity of the present invention apparatus forward when attached to one part of the cluster of bores 24, and shift the center of gravity of the present invention apparatus rearward when attached to another part of the cluster of bores 24. A narrow first base member 6 or second base member 8 provides for greater lumbar challenge. Since other accessory embodiments which are not shown in the attached illustrations are also contemplated as a part of the present invention, its scope should be determined by the appended claims and not limited to the examples provided.

I claim:

1. A portable stand-alone therapeutic seat exercise apparatus used upon an independent support surface to facilitate pelvic and lumbar mobility while an occupant is in a seated position, with at least one of the occupant's lower extremities being employed to maintain the occupant in a generally upright and balanced position during exercise movement, said apparatus comprising:

a contoured seat with an upper surface having a centrally extending longitudinal groove adapted for anatomical comfort, said upper surface having a rear portion that is substantially uniform in thickness dimension, said upper surface also having a forwardly sloping front portion, a bottom surface having structural support means adapted for support of the heaviest occupant contemplated for use of said contour seat, and said bottom surface also having a centrally located connection facilitating configuration adapted for placing said contoured seat in an unbalanced orientation for an occupant that challenges the occupant's pelvic and lumbar muscles to achieve a balanced orientation and as a result thereof facilitates and enhances the occupant's mobility; and a base member with an arcuate bottom surface that is configured for unrestricted movement in more than one direction, said base member also sized relative to said contoured seat so that said contoured seat will not come into contact with the independent support surface upon which said base member is placed during the efforts of an occupant seated upon said contoured seat to achieve a balanced orientation, said base member also having an opposed top end at least a portion of which is configured for engagement with said centrally located connection facilitating configuration of said contoured seat, as well as contact with said bottom surface of said contoured seat, so that when said top end of said base member is connected to said bottom surface of said contoured seat and a person occupies said upper surface of said contoured seat, the occupant of said contoured seat while in a seated position and with at least one lower extremity being used for stabilization, and to maintain balance in a generally upright orientation, is able to be actively seated so as to be capable of performing and receiving range of motion, isometric, isotonic therapeutic exercise to the lumbosacral spine, pelvis, abdomen, gluteal and thigh regions for enhanced low back mobility, stability, strength to enhance health, pain reduction, and improved function, instead of experiencing the diminished mobility that would otherwise occur as a result of passive sitting.

2. The apparatus of claim 1 wherein said base member and said arcuate bottom surface are further configured for occupant exercise and performing motion selected from a group consisting of rotation, rocking, wobbling, and tilting.

3. The apparatus of claim 1 wherein said contoured seat is further configured and dimensioned to provide anatomical relief to the genitorurinary region and contoured so as not to interfere with leg motion.

4. The apparatus of claim 1 wherein said base member is selected from a group consisting of hemispheric shaped base members, convex base members, base members that are separable from said seat, and base members having at least one top protrusion configured for connection of said base to said seat.

5. The apparatus of claim 1 having a lightweight and durable construction for enhanced portability.

6. The apparatus of claim 1 having a simple construction for ready manufacture and consumer affordability.

7. The apparatus of claim 1 wherein said base member and said arcuate bottom surface are further configured so that said apparatus enhances postural awareness, stimulates postural muscles, facilitates makings of a neutral lordotic spine, develops proprioceptive senses, and improves sitting balance.

8. The apparatus of claim 1 wherein said base member and said arcuate bottom surface are further configured for promoting pelvic and low back mobility while an occupant is seated in a motor vehicle in an environment of vibration for prolonged periods of time.

9. The apparatus of claim 1 wherein said base member and said convex bottom surface are further configured for unlimited rotation with minimal friction and no twisting of the occupant's spine for use in confined sitting areas that otherwise require twisting for access and egress.

10. The apparatus of claim 1 wherein said seat and said base member are separable from one another and said seat has a bottom surface with at least one vagination therein, and further comprising at least one accessory component configured to vary the height, angle of movement, arc of movement, and inherent stability of said apparatus, said at least one accessory component having a protrusion adapted for secure detachable connection to said vaginations in said seat and said base member.

11. The apparatus of claim 10 wherein said apparatus has a pivot location and said pivotal location is determined by the arc, height, firmness, and positioning of said base member and said at least one accessory component.

12. The apparatus of claim 11 wherein said base member is constructed of materials selected from a group consisting of smooth plastic, wood, metal, and said seat is constructed of materials selected from a group consisting of materials with a soft consistency capable of effectively producing the needed contours and motion requirements, wood, plastic, and metal.

13. A method of active sitting and exercise that enhances low back stabilization, coordination, strength, flexibility, and proprioceptive senses while an occupant is in a seated position, said method comprising the steps of:

providing a portable stand-alone therapeutic seat exercise apparatus comprising a contoured seat with an upper surface having a centrally extending longitudinal groove adapted for anatomical comfort, said upper surface having a rear portion that is substantially uniform in thickness dimension, said upper surface also having a forwardly sloping front portion, a bottom surface having structural support means adapted for support of the heaviest occupant contemplated for use of said contour seat, and said bottom surface also having a centrally located connection facilitating configuration adapted for placing said contoured seat in an unbalanced orientation for an occupant that challenges the occupant's pelvic and lumbar muscles to achieve a balanced orientation and as a result thereof facilitates and enhances their mobility and also comprising a base member with an arcuate bottom surface that is configured for unrestricted movement in more than one direction, said base member also sized relative to said contoured seat so that said contoured seat will not come into contact with the independent support surface upon which said base member is placed during the efforts of an occupant seated upon said contoured seat to achieve a balanced orientation, said base member also having an opposed top end at least a portion of which is configured for engagement with said centrally located connection facilitating configuration of said contoured seat, as well as contact with said bottom surface of said contoured seat; and using said apparatus on flat surfaces and existing seat surfaces during prolonged periods of sitting whereby the occupant performs and receive range of motion, isometric, isotonic therapeutic exercise to the lumbosacral spine, pelvis, abdomen, gluteal and thigh regions for enhanced mobility, stability, strength to enhance health, pain reduction, and improved function, instead of experiencing the diminished mobility that would otherwise occur as a result of passive sitting.

14. The method of claim 13 further comprising the step of providing at least one accessory component configured to vary the height, center of movement, or arc of movement of said base member, with said at least one accessory component having at least one protrusion, and the step of using said at least one accessory component by inserting said at least one protrusion into said vagination.

15. The method of claim 14 wherein said seat and said base are separable from one another and said seat has a bottom surface with at least one vagination therein, and said at least one protrusion is adapted for secure detachable connection to said vaginations in said seat and said base member wherein said at least one accessory component is configured to support rocking, tilting, and wobbling movement and vary in arc and position relative to said protrusion whereby anterior and posterior position can be achieved.

16. The method of claim 13 further comprising a step of using said apparatus to enhance low back stabilization, coordination, strength, flexibility, and proprioceptive senses while an occupant is seated.

17. The method of claim 13 wherein said seat comprises contours that comfortably accommodate pelvic anatomical structures.

18. The method of claim 17 wherein said seat further comprises channels and relief areas configured to result in relief of pressure to a user's buttock, genitalia, and posterior thigh regions.

19. The method of claim 13 wherein said base member is hemispherical and forms the primary support for rocking, tilting, rotating, and wobbling movement.

20. The method of claim 13 wherein said base member is constructed of materials selected from a group consisting of smooth plastic, wood, rubber, metal, and said seat is constructed of materials selected from a group consisting of materials with a soft consistency capable of effectively producing the needed contours and motion requirements, wood, plastic, rubber, and metal.

* * * * *